US006128906A

United States Patent [19]

Sillince

[11] Patent Number: 6,128,906

[45] Date of Patent: Oct. 10, 2000

[54] NON-METALLIC FOOD OR BEVERAGE CONTAINER HAVING A HEAT EXCHANGE UNIT CONTAINED THEREIN

[75] Inventor: Mark Sillince, Eaton Bray Dunstable, United Kingdom

[73] Assignee: Chill-Can International, Inc., Laguna Niguel, Calif.

[21] Appl. No.: 09/247,405

[22] Filed: Feb. 10, 1999

[51] Int. Cl.[7] ..... F25D 5/00; B65B 63/08

[52] U.S. Cl. ..... 62/4; 62/60; 62/371

[58] Field of Search ..... 62/4, 293, 294, 62/371, 60

[56] References Cited

U.S. PATENT DOCUMENTS

| | | | |
|---|---|---|---|
| 2,460,765 | 2/1949 | Paleith | 62/92 |
| 2,746,265 | 5/1956 | Mills | 62/4 |
| 3,373,581 | 3/1968 | Strader | 62/294 |
| 3,379,025 | 4/1968 | Donnelly | 62/4 |
| 3,636,726 | 1/1972 | Rosenfeld et al. | 62/294 |
| 3,726,106 | 4/1973 | Jaeger | 62/294 |
| 3,970,068 | 7/1976 | Sato | 126/263 |
| 4,566,838 | 1/1986 | Binning et al. | 414/278 |
| 4,584,848 | 4/1986 | Barnett | 62/294 |
| 4,773,389 | 9/1988 | Hamasaki | 126/263 |
| 4,784,678 | 11/1988 | Rudick et al. | 62/4 |
| 5,214,933 | 6/1993 | Aitchison et al. | 62/294 |
| 5,285,812 | 2/1994 | Morales | 137/393 |
| 5,325,680 | 7/1994 | Baroso-Lujan et al. | 62/294 |
| 5,331,817 | 7/1994 | Anthony | 62/5 |
| 5,606,866 | 3/1997 | Anthony et al. | 62/294 |
| 5,626,022 | 5/1997 | Scudder et al. | 62/4 |
| 5,655,384 | 8/1997 | Joslin, Jr. | 62/294 |
| 5,704,222 | 1/1998 | Hage et al. | 62/293 |
| 5,809,786 | 9/1998 | Scudder et al. | 62/4 |

*Primary Examiner*—William Doerrler
*Attorney, Agent, or Firm*—Fulbright & Jaworski L.L.P.

[57] ABSTRACT

An outer container constructed of a non-metallic material and an inner container constructed of metal permanently secured to said outer container. The inner container houses a material which when activated alters the temperature of food or beverage housed within the outer container and in contact with an outer surface of the inner container. Preferably, the outer container is constructed of food grade glass or plastic or paper products having a waterproof interior and the inner container is permanently affixed thereto by a threaded plug or a washer like member welded thereto respectively.

6 Claims, 4 Drawing Sheets

NON-METALLIC FOOD OR BEVERAGE CONTAINER HAVING A HEAT EXCHANGE UNIT CONTAINED THEREIN

BACKGROUND OF THE INVENTION

1. Field of the Invention

The present invention relates generally to containers for holding food or beverage within which there is also included a heat exchange unit having an outer surface which contacts the food or beverage and which when activated alters the temperature of the food or beverage. More specifically, it relates to such devices wherein the container is constructed from non-metallic material such as glass, plastic or paper products having a waterproof interior.

2. Description of the Prior Art

It has long been desirable to provide a simple, effective and safe device which may be housed within a container such as a food or beverage container for the purpose of altering the temperature of the food or beverage on demand.

In many instances such as when one is in locations where ice or refrigeration are not readily available such as camping, at the beach, boating, fishing or the like, it is desirable to have beverages which can be cooled before consumption. In the past, it has been necessary that the individual take ice chests or the like which contain ice and the containers for the beverages so that they can be consumed in the manner desired. The utilization of such ice chests is cumbersome, takes up a substantial amount of space and lasts for only a very limited time after which the ice must be replaced. While in use it is also necessary that the water resulting from the melted ice be drained from the ice chest from time to time.

There are many instances such as camping, boating, flying in an airplane or the like when it is desirable that a food or beverage be warmed or heated prior to consumption. In many instances such is not possible because there is no way in which a heat generating device such as a stove, electrical coil or the like is available to accomplish the heating of the food or beverage. Under such circumstances, the food or beverage although more palatable when heated would nonetheless have to be consumed in an ambient temperature stage.

In the prior art there are numerous instances of attempts to provide a container housing a food or beverage and also housing therein a heat exchange unit which when activated would alter the temperature of the food or beverage contained therein. Examples of such devices for chilling food or beverages are illustrated in prior art U.S. Pat. Nos. 2,460,765; 3,373,581; 3,636,726; 3,726,106; 4,584,848; 4,566,838; 4,784,678; 5,214,933; 5,285,812; 5,325,680; 5,331,817; 5,655,384; 5,606,866 and 5,655,384. A container being utilized for heating a food or beverage contained therein is illustrated in U.S. Pat. No. 5,626,022.

In all of the prior art devices as illustrated above, the container for housing the food or beverage has been constructed of metal and the heat exchange unit for altering the temperature of the food or beverage has also been constructed or metal with the heat exchange unit affixed to the outer container by way of crimping, welding, brazing or the like.

There are many instances at the present time where food or beverage is packaged in non-metallic containers such as those constructed from plastic or glass or paper products with a waterproof interior. Applicant, however, is unaware of any prior art non-metallic outer container for food or beverage which includes as a part thereof a heat exchange unit which when activated alters the temperature of the food or beverage contained in the non-metallic container.

SUMMARY OF THE INVENTION

A food or beverage container assembly having an outer container constructed of a non-metallic food grade material for receiving a food or beverage with a heat exchange unit comprising an inner container constructed of a metallic material having an outer surface contacting the food or beverage and containing a material which when activated will alter the temperature of the food or beverage along with means for activating the material. Means is provided for permanently affixing the inner container of metallic material to the outer container of non-metallic material.

The present invention is directed to the utilization of a food grade non-metallic container such as one constructed from glass or plastic or paper products with a waterproof interior housing food or beverage therein, the temperature of which should be lowered or raised from ambient temperature to make it more palatable for consumption by human beings. To accomplish this, the non-metallic container has incorporated internally therein a heat exchange unit constructed of metallic material which has an outer surface which comes into contact with the food or beverage contained within the outer container. A mechanism such as a valve is incorporated into the heat exchange unit which upon being activated or depressed will activate a material contained within the heat exchange unit causing the food or beverage material in contact with the outer surface of the heat exchange unit to have its temperature altered. If the material contained within the heat exchange unit is a refrigerant, then the temperature of the beverage or food will be lowered by having the heat content thereof removed through discharge of the refrigerant through the valve and into the atmosphere. There are many refrigerants which have been disclosed in the prior art such as halogen gases, for example chlorofluorocarbons, hydrofluorocarbons, a mixture of halogen gases and hydrocarbons, liquified hydrocarbon gases, ammonia, carbon dioxide and the like. In many instances these refrigerants may be dangerous since they are inflammable or they may be non-friendly to the environment by contributing to the greenhouse effect or the like. In accordance with a preferred embodiment of the present invention, a refrigerant system which includes a carbon-carbon dioxide adsorbent/desorbent refrigeration system is utilized. Such a system is disclosed in U.S. Pat. No. 5,692,381, which is incorporated herein by reference.

One system for applying heat to a food or beverage contained within an outer container is disclosed in U.S. Pat. No. 5,626,022, which is incorporated herein by reference.

Irrespective of whether the heat exchange unit is to cool the food or beverage or alternatively to heat the food or beverage, the present invention is equally applicable. The key features of the present invention include the utilization of a non-metallic outer container for housing the food or beverage such as one constructed from glass or plastic or paper products having a waterproof interior such as a plastic lining while having a heat exchange unit constructed of metallic material permanently affixed to the outer container in such a manner that it can be activated and upon being activated will alter the temperature of the food or beverage contained in the outer container.

Figure 1:
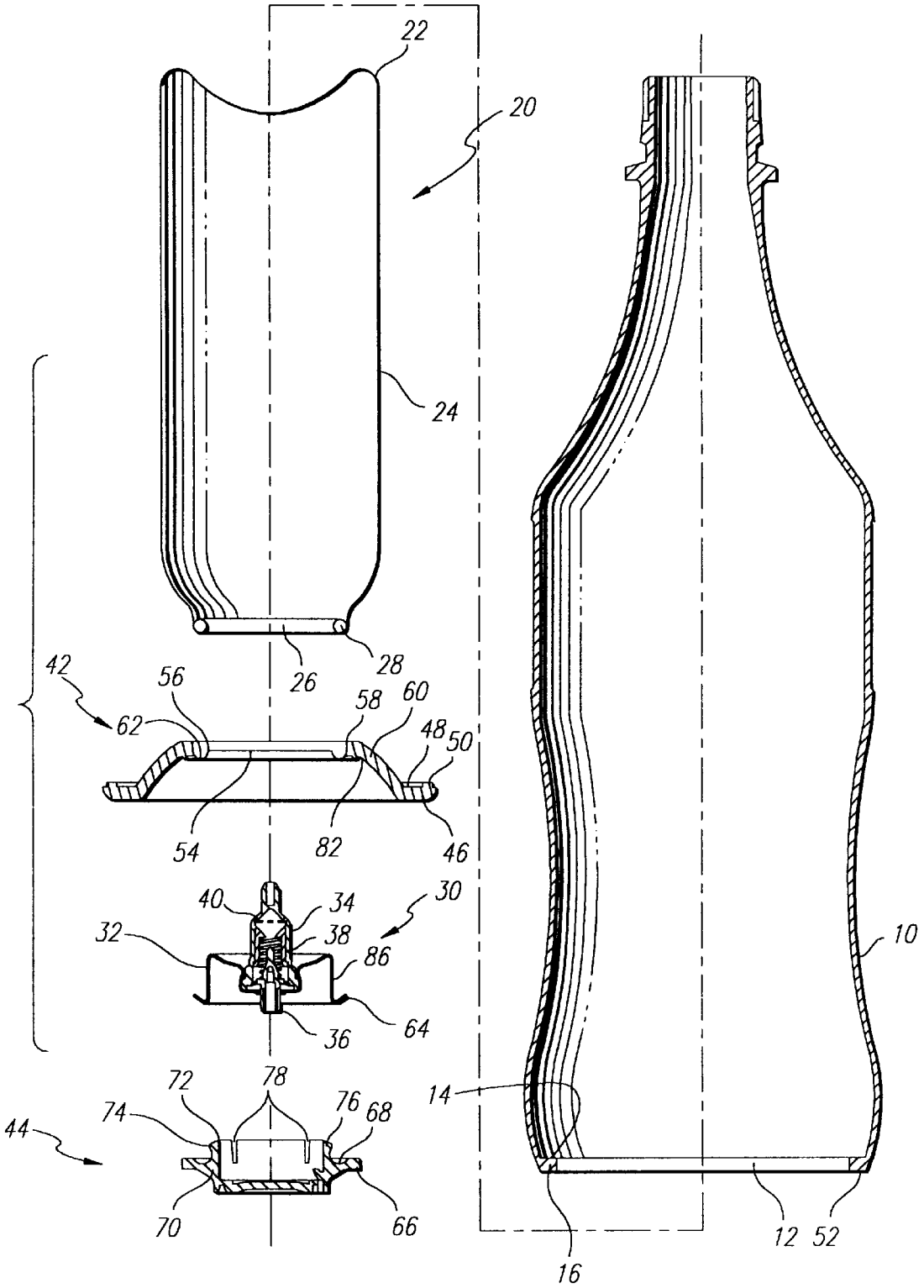
FIG. 1 is an exploded view of a food or beverage container assembly as constructed in accordance with the principles of the present invention.
Figure 2:
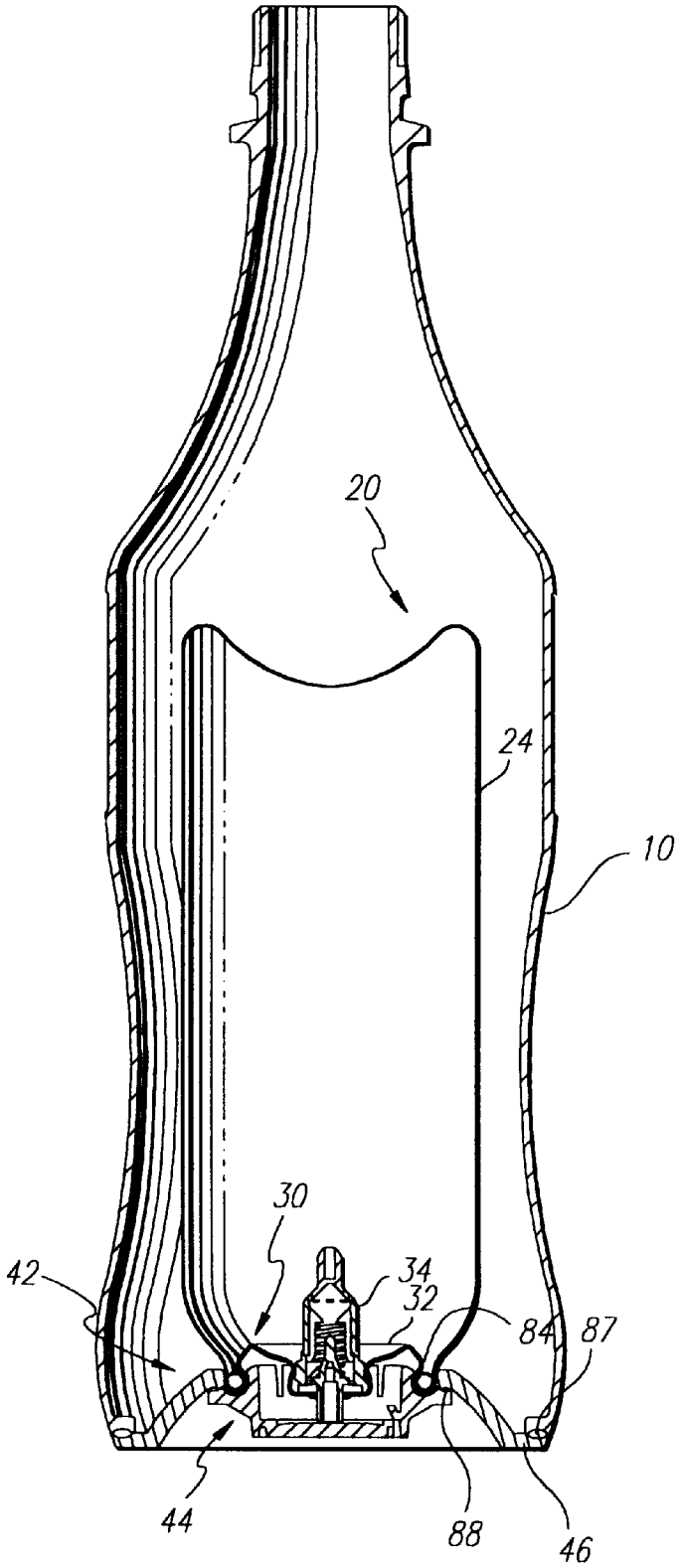
FIG. 2 illustrates the structure of FIG. 1 in assembled form.

Referring now more particularly to FIG. 1, there is illustrated in an exploded view one embodiment of a container assembly constructed in accordance with the principles of the present invention and more specifically such an assembly wherein the outer container is constructed of food grade plastic material. As is shown in FIG. 1, there is provided an outer container 10 preferably constructed of polyester plastic material (PET) which is well known in the prior art. The bottle 10 is formed with an opening 12 in the bottom 14 thereof. The opening is formed in such a manner that there is provided an inwardly directed circular flange 16 which defines the opening 12. In all other aspects the bottle 10 would be of a type utilized to contain a beverage or food such as those well known in the art. For purposes of illustration and ease of description only what is illustrated in FIGS. 1 and 2 is a typical plastic beverage bottle known to those skilled in the art other than for the opening 12 defined in the bottom thereof. A heat exchange unit 20 is provided and preferably includes an inner container 22 having an outer surface 24 which contacts the food or beverage (not shown) contained within the outer container 10 constructed of plastic material. Typically, the outer surface 24 of the heat exchange unit 20 would be coated with a food grade coating to prevent the food or beverage from coming into contact with the metallic material from which the heat exchange unit 20 is constructed. The heat exchange unit defines an opening 26 therein. The opening 26 is defined by curling the open end of the metallic container 22 as illustrated at 28. The curl may be either inwardly or outwardly depending upon the manner desired for construction of the inner container 22.

A valve mechanism 30 is utilized to close the opening 26 in the heat exchange unit 20 and when activated in turn activates the material contained internally of the container 22 to alter the temperature of the food or beverage contained within the outer container 10. Typically, the valve assembly 30 includes a metal valve cup 32 having a valve 34 secured thereto. A valve stem 36 is maintained in anon-activated position by an appropriate spring 38 contained internally thereof. Openings 40 are provided so that upon the stem 36 being depressed such as by pushing upwardly as illustrated in FIG. 1, the material contained within the inner container 22 (the heat exchange unit) will be allowed to escape from the interior thereof through the openings 40 and through the valve 34 as will be explained more in detail hereinafter. The plastic bottle 10 (without the opening 12) and the valve mechanism closing the heat exchange unit 20 are structures known to the art. However, there is no way known in the prior art, to applicant's knowledge, of permanently affixing a heat exchange unit 20 having the valve assembly 30 affixed thereto to a non-metallic container housing food or beverage.

There is shown at 42 a device which may be utilized for attachment to the flange 16 and which along with a protective cap 44 functions to close the opening 12 and secure the HEU 20 and valve 30 in place on the bottom of the plastic bottle 10 in a manner which will seal the contents of the food or beverage housed within the bottle 10 and prevent leakage or contamination thereof. The device 42 is a plastic washer shaped member having a radially outwardly extending flange 46 having an upper surface 48. A welding bead 50 extends transversely upwardly from the outwardly extending flange 46. The bead 50 will upon assembly as described below contact the surface 52 on the inwardly directed flange 16 surrounding the opening 12 of the bottle 10. Upon the application of appropriate heat and pressure the bead 50 will fuse with or melt into the surface 52 thereby sealing the member 42 to the bottom 14 of the bottle 10. The member 42 also defines an opening 54 therethrough. The opening 54 is defined by an inwardly directed lip 56 which is joined to an inwardly directed flange 58. The inwardly directed flange 58 is joined to the outwardly directed flange 46 by a body portion 60 of the member 42. As illustrated, a groove 62 is provided by the juncture of the lip 54 with the inwardly directed flange 58. The groove 62 is adapted to receive the curled edge 28 of the inner container 22.

As will also be noted, the valve cup 32 includes an outwardly directed and upwardly turned flange 64. When assembled, the lip 56 will be sandwiched between the curled edge 28 and the flange 64 and will function as a seal to prevent leakage of the contents of the container 10. Typically, in an assembly process after positioning of the lip 56 between the flange 64 and the curled edge 28, a crimping force will be applied to thereby secure the inner container 22 and the valve 30 together with member 42 trapped therebetween.

The actuator or protective cap 44 contains an outwardly directed flange 66 which defines a depression 68 therein. The actuator also includes a body 70, the lower portion of which at 72 has an outwardly directed ridge 74. As is also noted, the lower portion or skirt 76 includes a plurality of recesses or slits 78 therein allowing the skirt 76 to be deflected inwardly. Such structure allows the cap or actuator 44 to be snapped into place internally of the valve cup 32 as will be described more fully herein below.

The flange 66 on the actuator includes a surface 80 which upon being assembled, contacts an additional weld bead 82 directed downwardly from the flange 58 on the member 42. When the cap or actuator 44 is snapped into place, appropriate pressure and heat may be applied to the flange 66 causing the weld bead 82 to fuse or melt into the surface 80, thereby effecting an additional seal and completing the sealing of the opening 12 in the bottom of the plastic bottle 10.

Referring now more particularly to FIG. 2, the structure as described above in conjunction with FIG. 1 is shown in its assembled state. The reference numerals utilized in FIG. 1 have also been utilized for the same parts in FIG. 2.

As shown in FIG. 2, the valve cup 32 has been crimped as shown at 84 wherein the outer wall 86 thereof has been formed to extend outwardly over the curl 28 on the HEU inner container 22. Although the curl is illustrated in FIG. 2 as being undisturbed, in actual practice when appropriate pressure is applied to accomplish the crimping as shown at 84, the curl 28 may also be deformed somewhat thereby securely and sealingly affixing the valve cup 30 to the opening 26 in the inner container 22 of the HEU 20.

Welds 87 and 88 are shown in FIG. 2. The weld 87 is formed when the appropriate heat and pressure is applied to the flange 50 thus causing the bead 50 to fuse into the surface 52 of the flange 16 of the bottom 14 of the bottle 10. The weld 88 is formed when the appropriate heat and pressure is applied to the flange 66 causing the bead 82 to fuse into the surface 80 thereby sealing the protective cap to the member 42.

Figure 3:
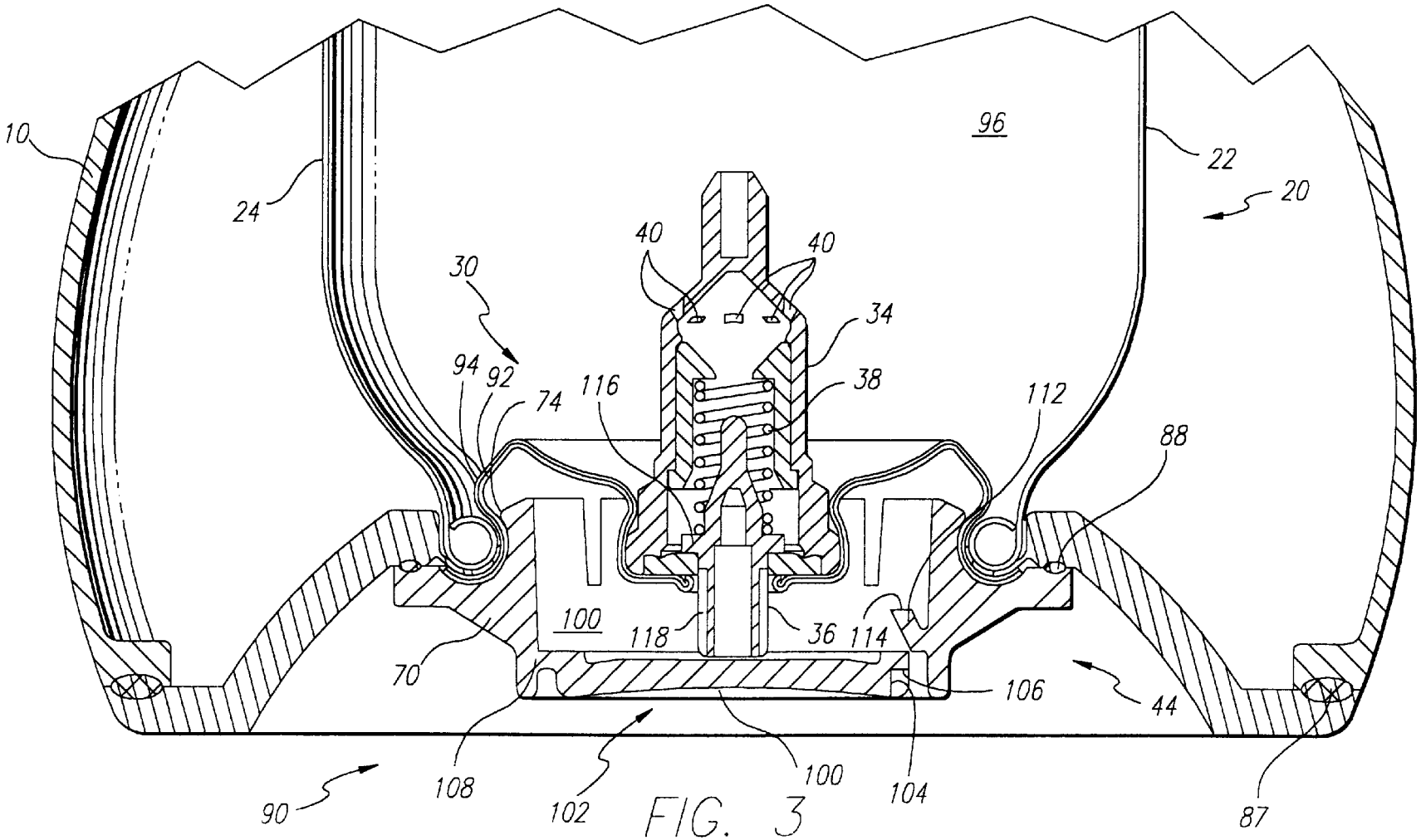
FIG. 3 illustrates in greater detail the specific manner of attaching the heat exchange unit to the container of non-metallic material.

Referring now more particularly to FIG. 3, the sealing mechanism for affixing the heat exchange unit 20 to the plastic bottle 10 is illustrated in greater detail. As is clearly shown in FIG. 3, the welds 87 and 88 clearly secure the entire attaching mechanism shown generally at 90 to the bottle 10. As is also illustrated, the valve cup 30 is constructed of a double layer, including a layer of metal 92 having an elastomeric coating 94 positioned thereon. The elastomeric coating assists in providing a seal for the material contained within the chamber 96 of the inner container 22 of the heat exchange unit 20. As is indicated in the prior art patents, which are incorporated herein by the foregoing reference, the material 96 is typically under pressure with the valve 34 maintaining the contents 96 within the inner container 22 and under pressure as required until the valve stem 36 is depressed. As is also clearly illustrated in FIG. 3, the outer protrusion 74 allows the protective cap body 70 to be snapped into place within the valve cup 32. The body 70 of the protective cover 44 includes a button 100 which when depressed by pushing inwardly as shown by the arrow 102 depresses the valve stem 36 against the force of the spring 38. The button 100 includes a reduced diameter area 104 which defines a shoulder 106. When the button 100 is depressed, it will swing about a hinge 108 and enter the chamber 110 by depressing a dog 112 inwardly as viewed in FIG. 3. As the shoulder 106 passes the edge 114 of the dog, the dog will then spring back to the position illustrated in FIG. 3 and surface 114 will engage the shoulder 106 thereby trapping the button in its actuating position thereby holding the valve stem 36 against the force of the spring 38. When such occurs, the material 96 contained within the inner container 22 will escape through the openings 40 and pass around the flange 116 and past groove 118 on the valve stem 36 and escape through the separation between the button 100 and the body 70 to the atmosphere. As such occurs, the contents in the form of food or beverage within the bottle 10 and in contact with the outer surface 24 of the inner container 22 will have the temperature thereof altered (i.e., cooled or heated) depending upon the material 96.

Figure 4:
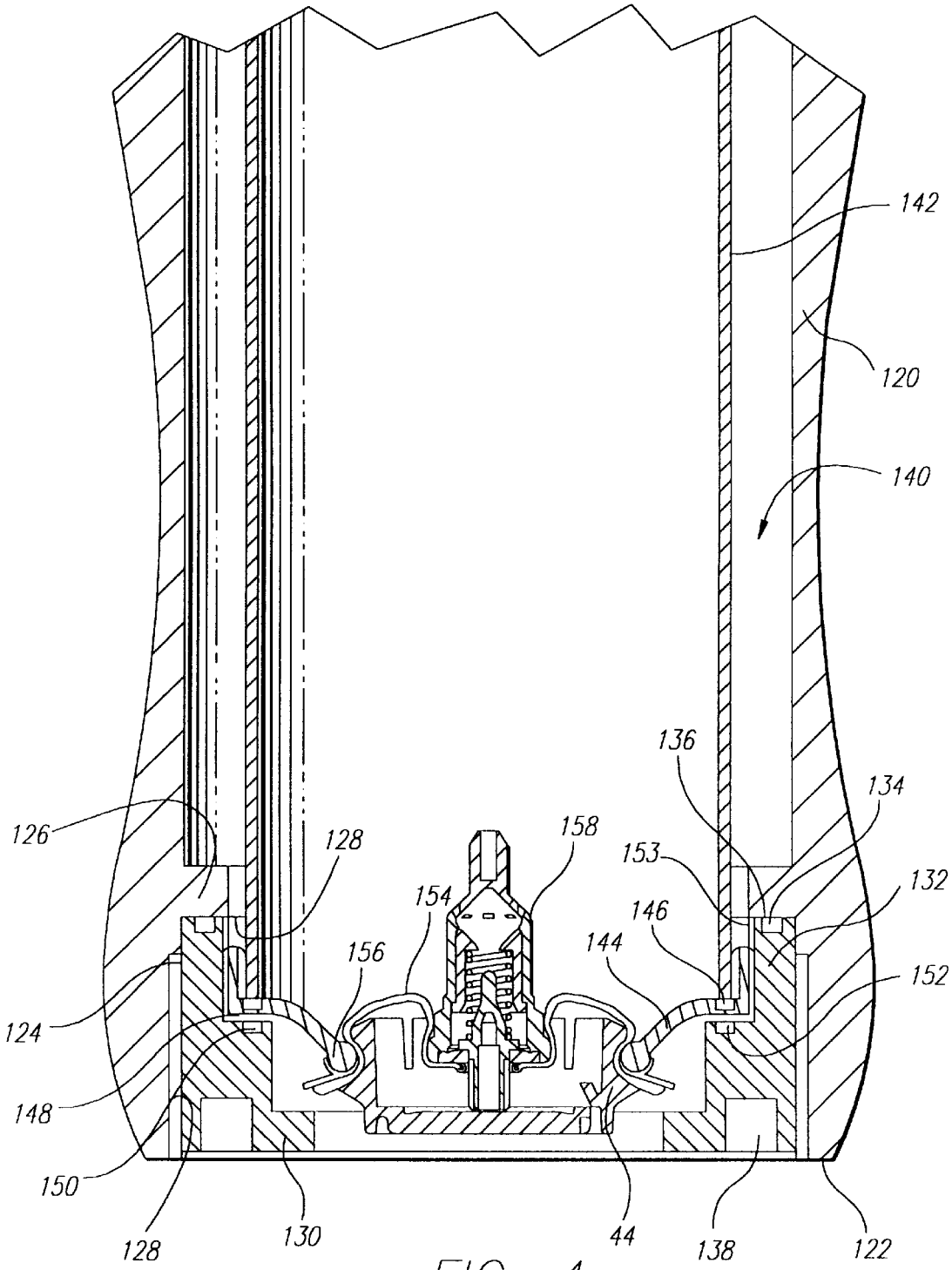
FIG. 4 is an alternative embodiment of a structure constructed in accordance with the principles of the present invention.

Referring now to FIG. 4, there is shown an alternative embodiment of a non-metallic container housing a metallic heat exchange unit constructed in accordance with the present invention. As is illustrated in FIG. 4, the container 120 is constructed of glass. Again, the container 120 is illustrated as a typical beverage bottle although such should not be taken as a limitation upon the claims appended hereto which define the scope of the present invention. The bottom 122 of the bottle 120 is open and defines a bore 124 terminating in an inwardly directed flange 126 defining a shoulder 128 around the entire interior of the bottle 120. The bore 124 defines securing structure such as threads 128. A threaded cap 130 having a skirt 132 depending therefrom is provided. The skirt 132 includes a groove 134 which houses an O-ring 136 or similar sealing device which abuts the shoulder 128 when the cap 130 is threadably secured in place by the utilization of an appropriate tool inserted into the recesses 138.

A heat exchange unit 140 having an inner container 142 constructed of metal is secured internally of the bottle 120. As is illustrated a metallic cap 144 is secured to the inner container 142 by threading or being crimped thereon. An appropriate seal 146 is provided between the inner container 142 and the cap 144. The cap 144 also includes an outwardly protruding sealing bead 148 which engages an additional O-ring 150 which is secured within a groove 152 provided on the closing cap 130. The skirt 132 includes an inwardly directed stop 153 which traps the cap 144 thereby securely holding the heat exchange unit 140 in place.

Similar to the structure above described there is provided a valve cup 154 which is crimped in place around an enlarged portion on the cap 144. A valve 158 similar to that described above is secured in place in the valve cup 154. Also included is a protective cap or actuator 44 which is constructed similarly to that described above. However, in this instance, the protective cap or actuator 44 is merely snapped in place within the crimped valve cup 154 and is not welded or otherwise secured thereto since such is not necessary in accordance with the structure as shown in FIG. 4.

The operation of the structure shown in FIG. 4 is identical to that illustrated in FIGS. 2 and 3 above and thus additional description thereof will not be provided with respect to the structure shown in FIG. 4.

What has been illustrated and described hereinabove is a structure wherein a non-metallic outer container constructed, for example, of glass or metal or paper products having a waterproof interior, may have a heat exchange unit having an inner container constructed of metal permanently and operatively secured to the non-metallic outer container so that upon activation of an appropriate valve contained as a part of the heat exchange unit, the contents of the heat exchange unit may be released thereby altering the temperature of the food or beverage contained within the non-metallic outer container.

What is claimed is:

1. A food or beverage containing assembly comprising:

an outer container constructed of a food grade plastic material for receiving a food or beverage and including a top and a bottom, said bottom defining an opening therethrough;

a heat exchange unit including, (a) an inner container having an open end and a closed end and constructed of a metallic material and having an outer surface for contacting said food or beverage;

(b) said heat exchange unit containing material which when activated will alter the temperature of said food or beverage;

(c) a valve assembly die posed in said open end for activating said material;

(d) a plastic washer shaped member defining a central opening therethrough, said heat exchange unit being secured to said washer member at said opening therethrough with said valve extending through said opening; and (e) said washer member spanning said opening in said bottom of said outer container, said outer container and said washer member being fuse bonded together at an area of mutual contact to close and seal said outer container bottom opening.

2. A food or beverage containing assembly as defined in claim 1 wherein said outer container and said washer member are fuse bonded by a weld seam between said washer member and said outer container adjacent said bottom opening.

3. A food or beverage containing assembly as defined in claim 2 which further includes a protective cover covering said valve assembly to protect the same against inadvertent actuation.

4. A food or beverage containing assembly as defined in claim 3 wherein said protective cover includes an actuating button and means for trapping said button in the actuated position after actuation of said valve by depressing said button.

5. A food or beverage containing assembly as defined in claim 4 wherein said cover is constructed of molded plastic material and defines a skirt which permits said cover to be snapped into place on said valve assembly.

6. A food or beverage containing assembly as defined in claim 5 wherein said body of said cover includes an outwardly extending flange which is fuse bonded in place on said washer member.

* * * * *